US005725321A

United States Patent [19]

Brannan et al.

[11] Patent Number: 5,725,321

[45] Date of Patent: Mar. 10, 1998

[54] JOURNAL PRINTER PAPER FEED FAULT DETECTION SYSTEM FOR AUTOMATED TELLER MACHINE

[75] Inventors: Jeffrey A. Brannan, Canton; Kim R. Lewis, Stow; Kenneth J. Schanz, Richmond Heights, all of Ohio

[73] Assignee: InterBold, North Canton, Ohio

[21] Appl. No.: 568,887

[22] Filed: Dec. 7, 1995

[51] Int. Cl.[6] ..... B41J 29/48; B41J 15/04; B65H 23/06

[52] U.S. Cl. ..... 400/708; 242/599.4; 242/599.3; 242/423.1; 242/571.5

[58] Field of Search ..... 400/708; 242/597.8, 242/597.6, 599.4, 597.5, 599.3, 423.1, 423.2, 571.4, 571.5

[56] References Cited

U.S. PATENT DOCUMENTS

| | | | |
|---|---|---|---|
| 745,500 | 12/1903 | Juelg | 242/596.7 |
| 1,817,134 | 8/1931 | Eighmey | 242/596.7 |
| 3,386,673 | 6/1968 | Mader | 242/571.5 |
| 3,833,180 | 9/1974 | Balasic | 242/598.3 |
| 4,239,404 | 12/1980 | DeFilipps et al. | 400/613 |
| 4,479,615 | 10/1984 | Nakajima et al. | 242/599.3 |
| 4,925,121 | 5/1990 | Tapscott et al. | 242/563.2 |
| 5,238,198 | 8/1993 | Jingu et al. | 400/613 |
| 5,417,783 | 5/1995 | Boreali et al. | 156/64 |

FOREIGN PATENT DOCUMENTS

| | | | |
|---|---|---|---|
| 586556 | 11/1959 | Canada | 242/596.7 |
| 433076 | 6/1994 | European Pat. Off. . | |
| 715282 | 6/1996 | European Pat. Off. . | |
| 2145399 | 3/1985 | United Kingdom . | |

*Primary Examiner*—Edgar S. Burr
*Assistant Examiner*—Daniel J. Colilla
*Attorney, Agent, or Firm*—Ralph E. Jocke

[57] ABSTRACT

A system for indicating fault conditions in an automated banking machine includes a journal printer (12). The journal printer is supplied with paper from a paper supply roll (16). The paper supply roll is supported on a spindle (22). The spindle is engaged to the paper roll by spring arms (60). The spindle further includes a spring loaded retainer member (42) and a flange portion (34) which act to apply a drag force on the spindle to prevent overrunning. The spindle also has an encoder member (40) thereon. Rotation of the encoder member is sensed by an opto-electrical detector (70). A diameter of the paper supply roll is sensed by a second opto-electrical detector (78) positioned between the spindle and the printer. The detectors are connected to an electronic circuit (74) including a processor (76). Fault signals are generated by said electronic circuit responsive to said detectors sensing conditions representative of paper jam, paper low and paper out conditions.

40 Claims, 5 Drawing Sheets

JOURNAL PRINTER PAPER FEED FAULT DETECTION SYSTEM FOR AUTOMATED TELLER MACHINE

TECHNICAL FIELD

This invention relates to automated banking machines. Specifically, this invention relates to a system and method for detecting fault conditions which occur in the feeding of paper through a journal printer mechanism in an automated teller machine.

BACKGROUND ART

Automated banking machines are well known in the prior art. In many types of automated banking machines, including automated teller machines (ATMs), it is common to include a journal printer inside the machine. The function of the journal printer is to make a paper record of each transaction that has been conducted at the ATM. This enables the institution that operates the ATM to verify its electronic records and to reconstruct them in the event of a failure.

Journal printers typically involve recording transaction information on paper that is supplied from a paper roll. The paper from the roll is passed through the printer where the data is printed on the paper. After printing, the paper is rewound onto a take-up roll. As transactions are recorded, blank paper on the supply roll is used and the diameter of the supply roll decreases. As paper upon which data has been recorded is transferred to the take-up roll, the take-up roll increases in diameter. Eventually, when the amount of paper remaining on the supply roll is nearly depleted, the supply roll must be replaced and the paper on the take-up roll removed. The process is then repeated with additional transactions being recorded on the paper from a new supply roll.

The reliable operation of the journal printer is important to insure that the institution operating the ATM has a hardcopy record of all the transactions that have been conducted. It is undesirable for the supply roll of the journal printer to be depleted, as this results in transactions for which there may be no hardcopy record. In some existing ATMs, the need to replace the supply roll is determined electronically by storing in the memory of the machine the number of data lines printed by the journal printer since the last roll change. Such systems require for their operation that all replacement rolls be identical. This is not always the case. If the roll is either "too short" or "too long" a paper out condition may arise or excess paper may be unnecessarily discarded.

A person servicing the ATM to replace the supply roll may forget to reset the system when the paper is replaced. This can result in the automated teller machine indicating that it is in a paper low condition when in fact no such problem exists. Also, a problem such as a paper jam may occur in the middle of a roll. In this situation the technician must start a new roll and reset the machine. This may waste a significant amount of paper.

Journal printers sometimes experience paper jams. Paper jams usually result in the paper no longer moving through the printer. The printer mechanism prints data concerning a multitude of transactions on the same spot. As a result, the hardcopy record of these transactions is lost. Only the most severe paper jams that trigger signals indicating a malfunction in other components are generally detected by existing automated teller machines. For example, if the paper jam condition is sufficient to prevent the printer mechanism from moving as required to produce characters on paper, a printer fault indication may be given. However in most circumstances, paper jams are not sufficiently severe to impact the operation of other components. Such paper jams go undetected until a visual inspection is made by a service technician.

Other types of fault conditions may arise with regard to a journal printer. A technician may remove a spent roll and forget to put in a new one even though the machine has been reset. Paper rolls may also have breaks at splices. In either case the journal printer will become inoperative and this condition may go undetected for some time.

Problems may also result when a replacement roll has not been properly installed. The ATM may be run for an extended time before it is discovered that paper is not feeding through the journal printer.

Thus there exists a need for a system and method for indicating fault conditions with paper feeding to a journal printer in an automated banking machine.

DISCLOSURE OF INVENTION

It is an object of the present invention to provide an apparatus for indicating a fault condition in a system in which a printer is supplied with paper from a paper roll.

It is a further object of the present invention to provide an apparatus for indicating a paper jam condition with a journal printer in an automated banking machine.

It is a further object of the present invention to provide an apparatus for indicating a paper low condition for a supply roll supplying a journal printer in an automated banking machine.

It is a further object of the present invention to provide an apparatus for indicating fault conditions in a system including a journal printer in an automated banking machine which is supplied by a paper roll and which prevents overrunning of the roll.

It is a further object of the present invention to provide an apparatus for indicating fault conditions in a system including a journal printer in an automated banking machine which detects the movement of a journal printer supply roll and which determines that such roll is moving in coordination with a journal printer.

It is a further object of the present invention to provide an apparatus for detecting proper movement of a journal printer supply roll which enables readily changing the supply roll.

It is a further object of the present invention to provide an apparatus for detecting the proper movement of a journal printer supply roll which apparatus is engaged with said supply roll so as to indicate the movement thereof but which is readily disengagable from said supply roll to enable the replacement thereof.

It is a further object of the present invention to provide an apparatus for indicating fault conditions with a paper feed from a roll to a printer, which apparatus may be used with rolls of varying size.

It is a further object of the present invention to provide an apparatus for indicating improper loading or a failure to load, a paper roll supplying a printer.

It is a further object of the present invention to provide an apparatus for detecting severance of paper from a paper roll supplying a printer.

It is a further object of the present invention to provide a method for indicating a fault condition in a system in which a journal printer is supplied with paper from a paper roll.

Further objects of the present invention will be made apparent in the following Best Mode for Carrying Out Invention and the appended claims.

The foregoing objects are accomplished in a preferred embodiment of the present invention by an apparatus for indicating fault conditions in a transaction recording system within an automated banking machine. The system includes a journal printer that is supplied with paper from a paper supply roll. The printer operates to move paper from the supply roll and to print transaction data thereon. The paper with the printed data is rewound on to a take-up roll.

The paper supply roll is supported on a spindle. A wire spring extending from the spindle serves as a connecting member and connects the spindle to the supply roll. As a result, the spindle is rotatably engaged with the roll so as to move therewith. An encoder member is supported on one end of the spindle. The encoder member includes a plurality of uniformly spaced indicia which in the preferred form of the invention are a plurality of slotted openings.

An optical detector is positioned adjacent to the encoder member. The detector operates to detect rotation of the encoder member which is indicative of rotation of the paper roll. A drag mechanism is associated with the spindle which prevents overrunning of the supply roll as paper is removed therefrom by the printer.

The system further includes a second detector adjacent to the paper supply roll. The second detector serves as a paper low detector and senses a side face portion of the roll. The second detector is operative to provide a signal when the diameter of the supply roll has fallen to a predetermined level.

An electronic circuit, which includes a processor, is in operative connection with the printer and the first and second detectors. The processor is programmed to provide fault signals when a combination of certain conditions are detected in accordance with the programming of the processor.

In operation, a first fault signal representative of a paper jam condition is generated by the electronic circuit if the second detector senses sufficient paper, but the first detector has failed to sense rotation of the spindle shaft after the printer has operated to print a number of lines. This first fault signal is indicative that the printer is attempting to print several lines of data on the paper but that the paper is not moving. The first fault signal is also generated in conditions where the paper roll is broken, such as at a splice, or when a replacement roll has not been properly installed.

The electronic circuit provides a paper low signal when the second detector senses that the paper supply roll has been reduced to a sufficiently small diameter that replacement is warranted. The paper low signal is given if the first detector is continuing to sense that the paper is still moving. This is indicative that the journal printer is still operating despite the paper running low.

The electronic circuit further provides a paper out signal when the printer has printed the number of lines during which time movement of the spindle should have been sensed, and if at the same time the second detector does not sense the presence of paper. This is indicative that the paper supply roll has been depleted and that a hardcopy record of transaction data is not being retained. This second fault signal indicative of a paper out condition is also given in circumstances when a replacement roll was not installed or was improperly installed due to a mistake by a service technician.

BEST MODE FOR CARRYING OUT INVENTION

Figure 1:
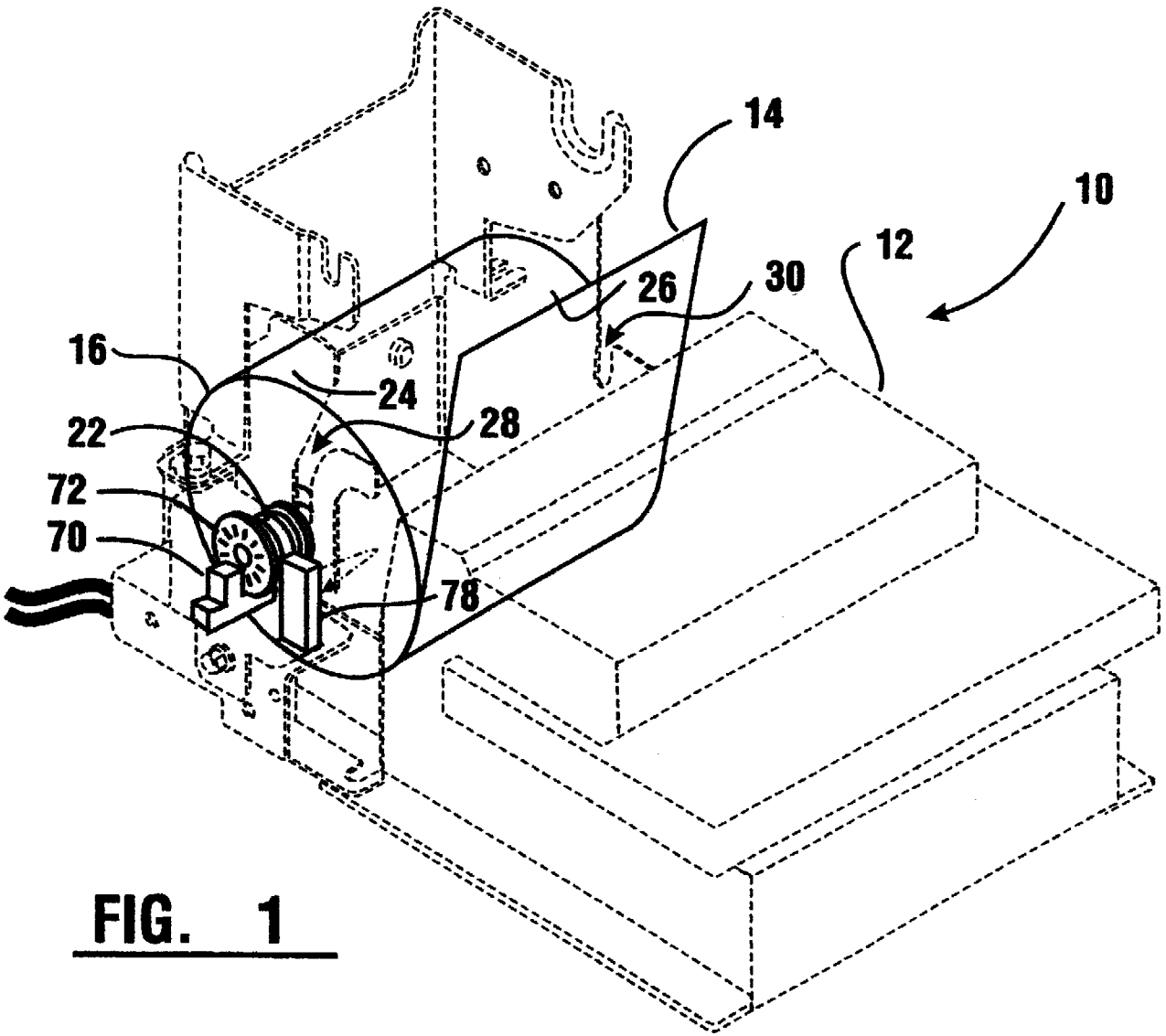
FIG. 1 is an isometric view of a journal printer including the fault indicating apparatus of the present invention.

Referring now to the drawings and particularly to FIG. 1, there is shown therein the fault indicating apparatus of the present invention generally indicated 10. The apparatus includes a journal printer generally indicated 12. Journal printer 12 includes mechanisms known in the prior art for producing printed data on paper in a conventional manner.

Figure 2:
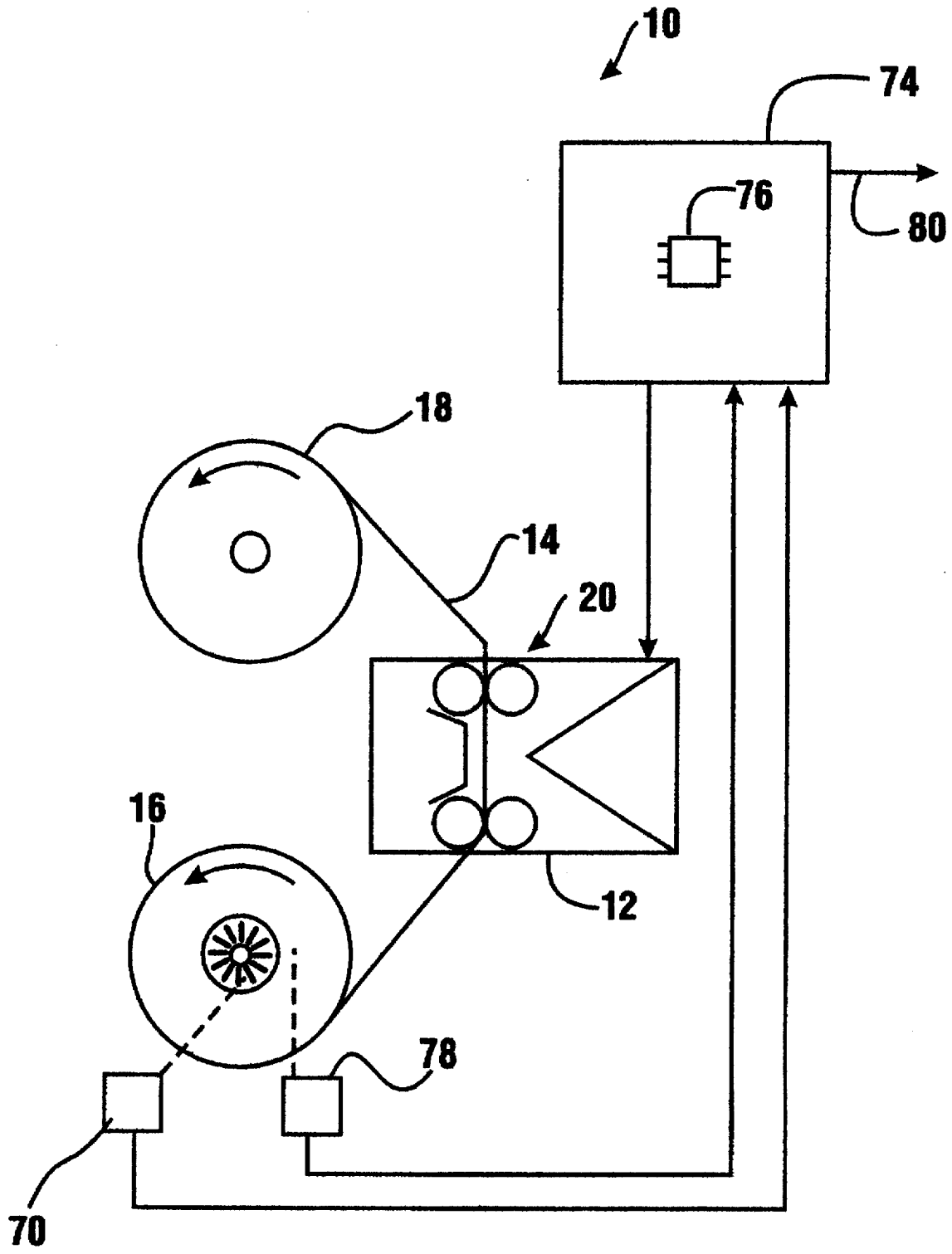
FIG. 2 is a schematic view of a journal printer including the fault indicating apparatus of the present invention.

Paper generally indicated 14, is fed from a paper supply roll 16 to printer 12. As schematically indicated in FIG. 2, paper that has been printed on by the journal printer 12 is stored on a take-up roll 18. Printer 12 includes a conventional type drive schematically indicated 20 for moving the paper 14 therethrough after each line of data has been printed thereon. Take-up roll 18 is also driven by a conventional mechanism so as to rewind and store on the take-up roll the paper that has been printed on by journal printer 12.

Figure 3:
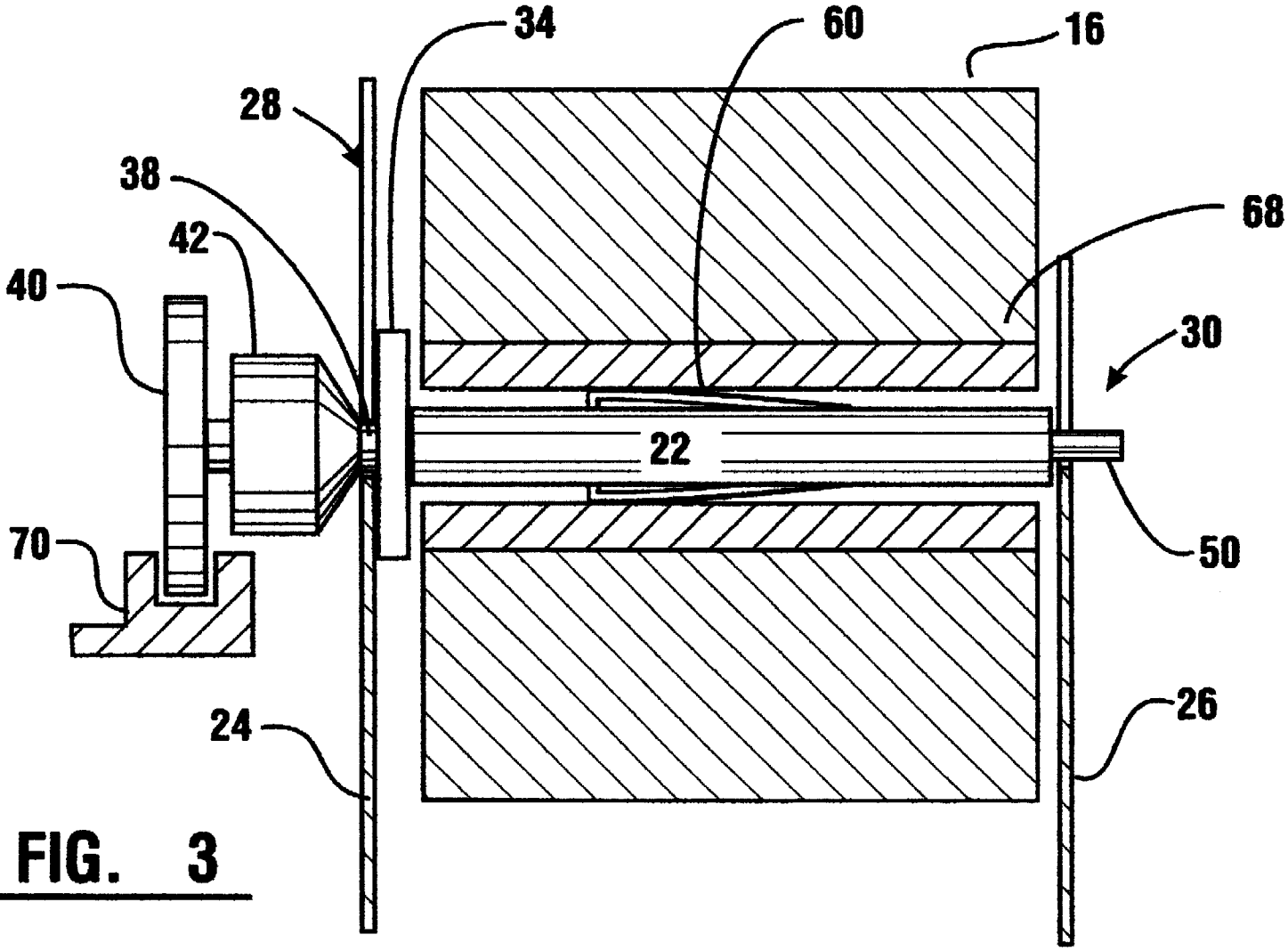
FIG. 3 is a sectional side view of a paper supply roll, spindle and spindle rotation detector of the preferred embodiment of the present invention with an inside diameter of a paper roll core exaggerated to more clearly show the action of a pair of spring arms connecting the roll and spindle.

Paper supply roll 16 is supported on a spindle generally indicated 22. The spindle is shown in detail in FIGS. 4 and 5. Spindle 22 is supported on a first side by a first vertically extending wall 24. Spindle 22 is supported at an opposed side by a second vertically extending wall 26. First wall 24 includes a first slot 28 therein. First slot 28 includes an open end and a closed end. The spindle is supported at the closed end of slot 28 when in the operative position as shown in FIG. 3. However, the spindle may be removed from the slot 28 through the open end to enable replacement of the supply roll and then reinstalled in a manner later discussed.

Second wall 26 includes a second slot 30. Second slot 30 has open and closed ends. The spindle is supported at the closed end of the second slot when in the operative position as shown in FIG. 3. Similarly, the spindle may be removed through the open end of the slot when the supply roll is depleted and reinstalled after the roll is replenished.

Figure 4:
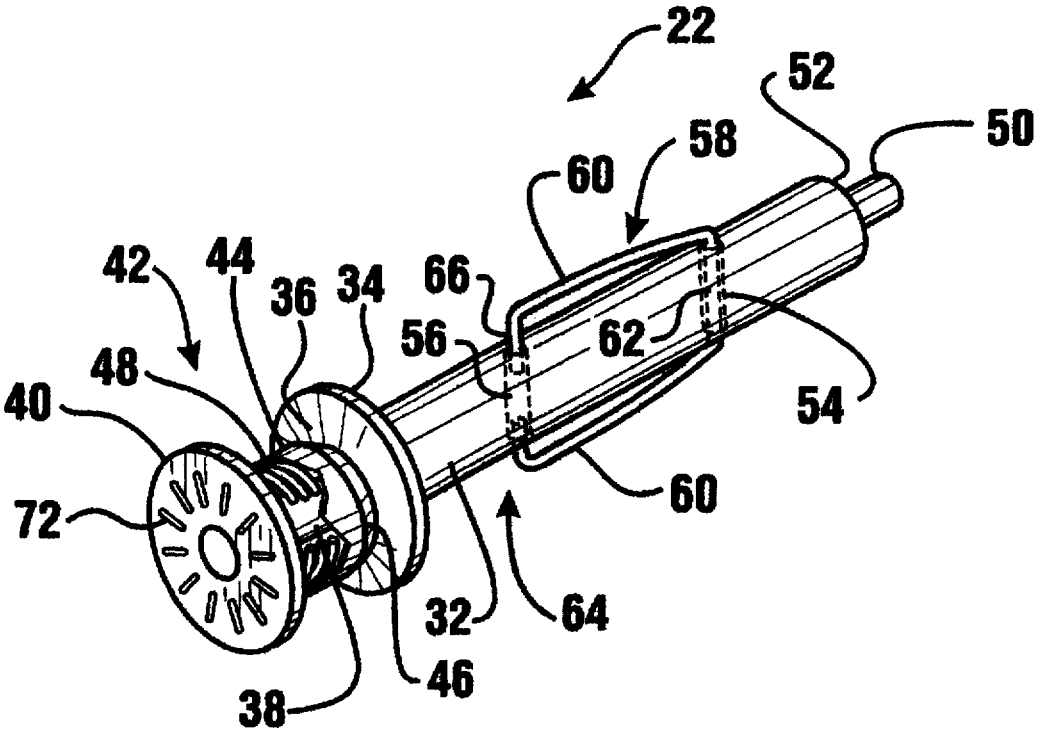
FIG. 4 is an isometric view of the spindle of the present invention shown with the spring arms extended.

Spindle 22 is shown in detail in FIG. 4. Spindle 22 includes a spindle shaft portion 32. A flange portion 34 is located at a first end of spindle shaft portion 32. A flange portion 34 includes a flat circular face 36, the purpose of which is later discussed.

An encoder support shaft portion 38 extends axially outward from flange portion 34. Encoder support shaft portion 38 supports an encoder member 40. In the preferred form of the invention, encoder member 40 is an encoder wheel with a plurality of radially extending slotted openings positioned at a plurality of uniformly spaced radial increments thereon.

A retainer member 42 is movably positioned between flange portion 34 and encoder member 40. Retainer member 42 is a generally hollow member with an opening (not shown) through which shaft portion 38 extends. The retainer member is enabled to move in an axial direction on the encoder support shaft portion 38. Retainer member 42 includes externally a cylindrical portion 44 and a generally frustoconical portion 46. Generally frustoconical portion 46 includes the opening therethrough that enables retainer member 42 to move relative to shaft portion 38.

A compression spring 48 is housed in a generally cylindrical pocket inside retainer member 42. Compression spring 48 is a coil spring that extends coaxially with encoder support shaft portion 38. Spring 48 biases the generally frustoconical portion 46 of the retainer towards face 36 of the flange portion 34. However, in response to a separating force, the frustoconical portion 46 may be moved away from face 36.

A guide shaft portion 50 is positioned at an opposite end of spindle shaft 32 from flange 34. Guide shaft portion 50 is smaller in diameter than spindle shaft portion 32. A radially extending step 52 extends between guide shaft portion 50 and spindle shaft portion 32.

Spindle shaft portion 32 includes a diametrically extending opening 54 therethrough. A second opening 56 in spindle shaft portion 32 is axially disposed from opening 54 in the direction of flange portion 34. A generally u-shaped wire spring 58 extends between openings 54 and 56. Spring 58 includes a pair of outwardly biased spring arms 60 which extend from a spring base 62. Spring base 62 extends through opening 54 in shaft portion 32 as shown in FIG. 4. Spring arms 60 each include free ends generally indicated 64 which each have radially in-turned portions 66. In-turned portions 66 extend into opening 56 in spindle shaft portion 32.

Figure 5:
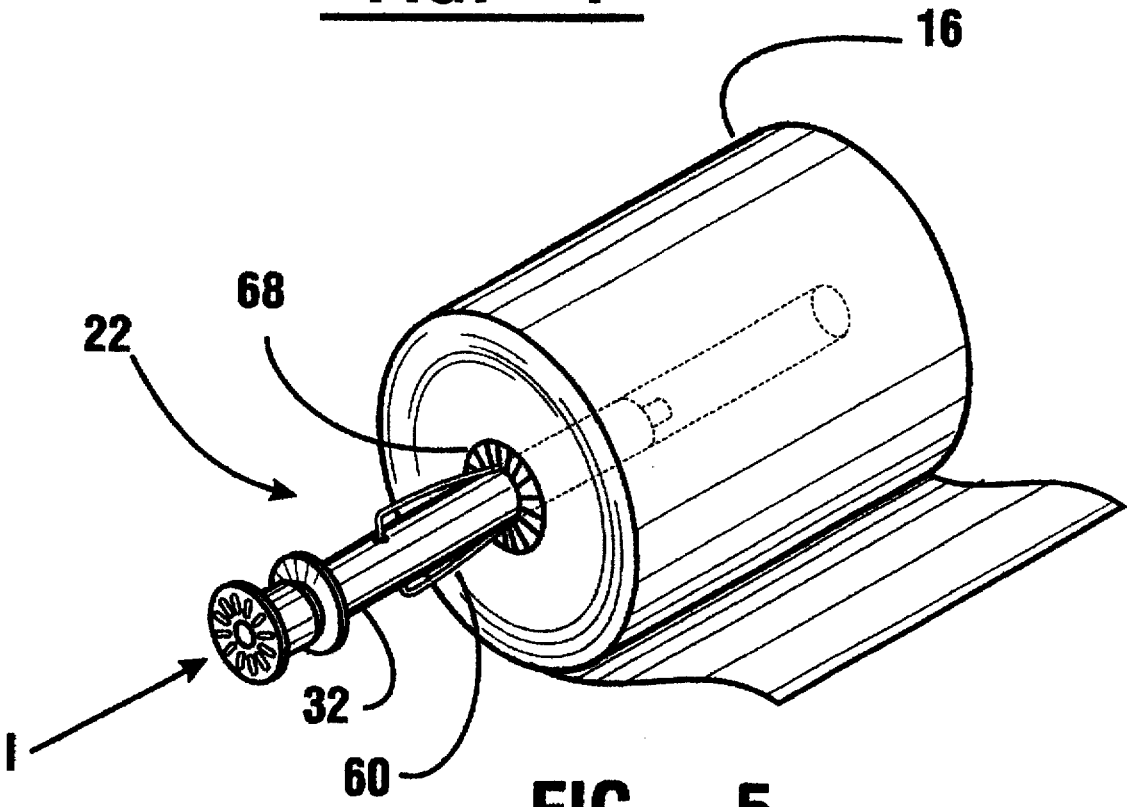
FIG. 5 is an isometric view showing the spindle partially inserted into a paper supply roll.

As shown in FIG. 5, when paper supply roll 16 is installed on spindle 22, spindle shaft portion 32 is inserted into a core 68 at the center of the paper roll 16. As the spindle shaft is inserted into the core, the engagement of the core with the spring arms moves the spring arms against the biasing force of the wire spring so that the in-turned portions 66 are moved further into opening 56 in the spindle shaft portion. The outward biasing force of the spring arms maintains engagement between the spindle 22 and the core 68 of the paper roll 16. As a result, the spring arms 60 serve as connecting members for connecting the spindle to the paper roll so that the spindle is rotatably engaged therewith. This enables the encoder member 40 to move in response to movement of the paper roll. This enables the detection of fault conditions in a manner hereinafter discussed.

The spindle 22 is installed in the roll 16 by movement of the spindle in the direction of arrow I as shown in FIG. 5 until flange portion 34 engages a side face of the core and paper roll. The spindle 22 is then installed in supported connection with walls 24 and 26. Installation into supported connection with the walls is accomplished by engaging guide shaft portion 50 in second slot 30 and engaging the encoder support shaft portion 38 in the slot 28. Engaging encoder support shaft portion 38 in slot 28 necessitates the movement of retainer member 42 away from flange portion 34 a sufficient distance to enable wall 24 to extend therebetween. This is accomplished by engaging the tapered generally frustoconical portion 46 of the retainer in the open end of slot 28 and moving spindle 22 downward. This downward movement biases the retainer member 42 axially outward against the biasing force of compression spring 48. This enables spindle 22 to be moved so that shaft portion 38 is supported at the closed end of slot 28 as shown in FIG. 3.

When the spindle 22 is supported in slots 28 and 30 as shown in FIG. 3, retainer member 42 applies a biasing force against the outer surface of first wall 24. This biasing force causes wall 24 to be in compressed sandwiched relation between flange portion 34 and retainer member 42. The frictional forces that are applied by face 36 of flange portion 34 on the inside of wall 24 combined with the frictional force of the retainer member 42 engaging the outer surface of wall 24, act to resist rotation of spindle 22. Because spindle 22 is connected to paper roll 16 through the spring arms 60, these structures act as a drag mechanism to prevent spindle 22 from freely rolling in response to forces applied thereto. As a result, when roll 16 is moved in response to printing operations being conducted by journal printer 12, roll 16 is prevented from overrunning by the drag mechanism.

The apparatus of the present invention further includes a detector 70. In the preferred form of the invention detector 70 is an opto-interrupter sensor. Detector 70 is operable to detect the passage of a beam of light through the openings 72 in the encoder member 40 as the openings are aligned with the sensor. As spindle 22 rotates, detector 70 sequentially senses the passage and blockage of light as openings 72 are aligned in the sensor.

As schematically shown in FIG. 2, detector 70 is electrically connected through an appropriate interface to an electronic circuit schematically indicated 74. Electronic circuit 74 includes a processor 76 which operates in accordance with the steps of a computer program hereinafter described. Electronic circuit 74 is also connected to journal printer 12 for purposes that are later discussed.

The apparatus of the present invention further includes a second detector 78. Second detector 78 is also preferably an opto-electric detector. Second detector 78 is positioned between the spindle and the journal printer. Second detector 78 preferably operates to direct a light beam against a side face portion of paper supply roll 16 and to detect the light reflected from such surface. As a result, when the diameter of roll 16 has decreased so that the side face surface is no longer present in the area adjacent second detector 78, this condition may be sensed as shown in FIG. 2. In other embodiments other types of detectors may be used instead of electro-optical detectors. Second detector 78 is electrically connected through an appropriate interface to the electronic circuit 74. Electronic circuit 74 operates as schematically indicated in FIG. 2 to output electrical signals on a line schematically indicated 80.

Electronic circuit 74 operates to output fault indication signals in response to a determination that there is a paper jam or a comparable condition, that the paper on the supply roll is low, or that the paper on the supply roll is out or a comparable condition. These signals are given in response to processor 76 which executes generally the computer program steps indicated in FIG. 6.

It will be understood by those skilled in the art that because the diameter of paper supply roll 16 varies as paper is used, the amount that the spindle will rotate in response to printer 12 removing a predetermined amount of paper from the roll will vary. The spindle will rotate a lesser amount for a given length of paper when the roll is new. The roll will gradually increase the angular displacement for a given amount of paper as the roll reaches depletion. Printer mechanisms are generally set up such that each line of printed data occupies a predetermined width on the paper. This width extends in a transverse band. Each time the printer is instructed by the printer driver control to move to the position to print the next line of data, the drive 20 of the printer operates to attempt to move the paper forward a predetermined distance. Because the printer advance for each line of data is constant, but the amount of associated rotation of the spindle and the attached encoder member 40 varies, the processor of the present invention is programmed so as to prevent the generation of fault signals in circumstances where the encoder member has only moved slightly due to the large diameter of the roll.

Figure 6:
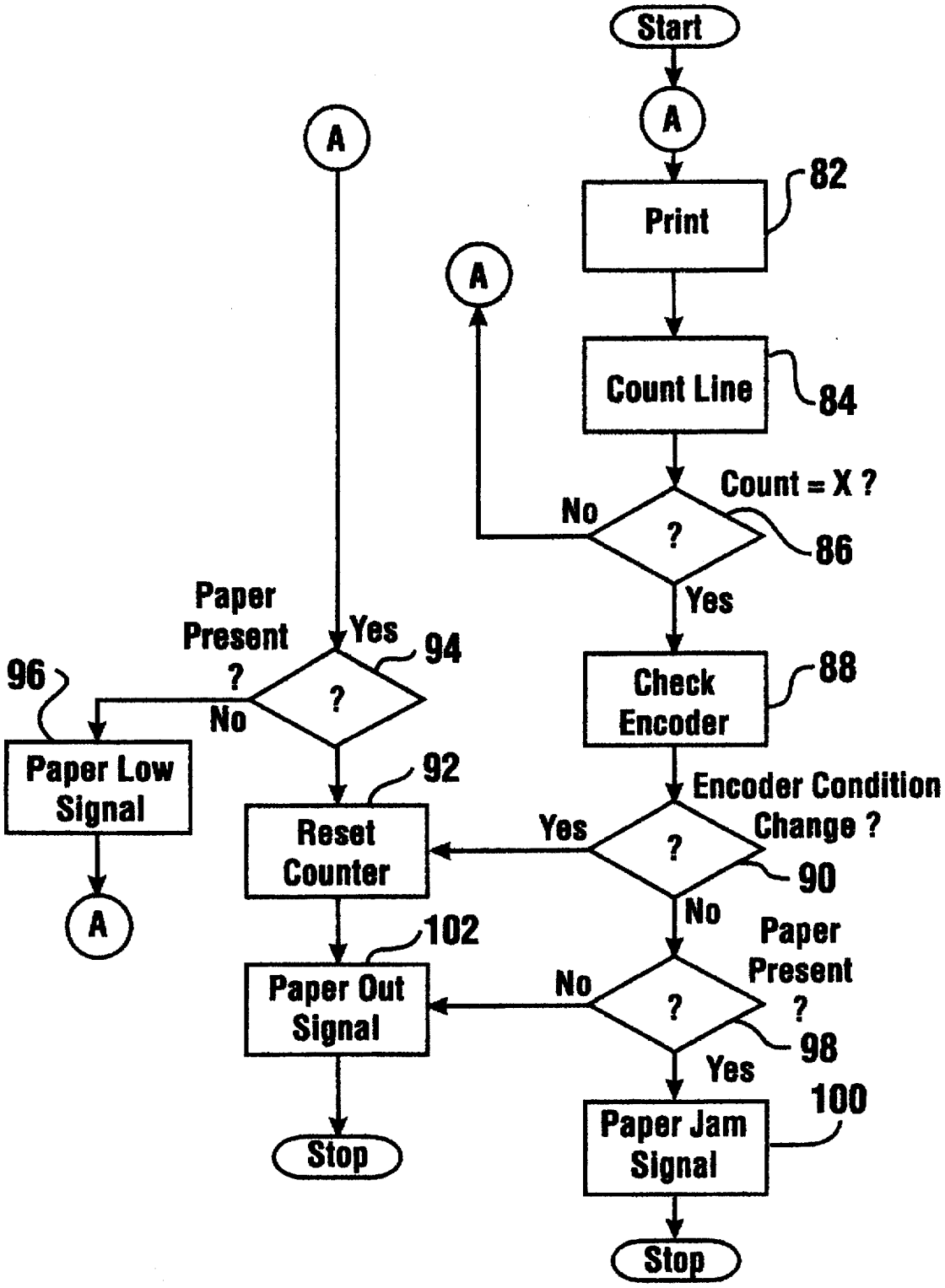
FIG. 6 is a flow chart of the computer program executed by the processor of the electronic circuit used in the fault indicating apparatus of the present invention.

As shown in FIG. 6, the processor 76 is connected to printer 12 so as to enable the printing of a line of data on the paper at a step 82. A counter is then incremented at a step 84 to note that an additional line has been printed. At a step 86, the counter is checked to determine if the number of lines that have been printed is equal to a set number. This set number is preprogrammed so that for the largest roll to be installed on spindle 22 the encoder member must have moved sufficiently so as to produce a change in signal at detector 70 after the preset number of lines is printed. If the counter has not yet reached this preset limit, the program returns to print the next line. If it has, the program moves on.

At a step 88, the processor checks to determine if there has been a change in signal from detector 70. This would indicate that the spindle has rotated enough to indicate at least one change from "dark" to "light" or vice versa. At a step 90, a decision is made as to whether such a change in signal from detector 70 has occurred. If at least one change in signal has occurred, the counter is reset at a step 92. A step 94 is then executed to check if paper is sensed by second detector 78. If paper is present adjacent the second detector, then the processor enables the program to return. The printer will then print the next line. However if paper is not sensed adjacent to second detector 78, a "paper low" signal is generated at step 96. Because it is desirable to operate the journal printer as long as possible, even if the paper is low, the processor continues to operate the printer.

If in executing the computer program, it is determined in step 90 that the encoder has not changed condition since the last check, this is representative of a problem. The processor then executes step 98 wherein the processor seeks to determine if paper is sensed adjacent to second detector 78. If paper is present, but the spindle is not moving, the processor indicates a first fault detection signal representative of a paper jam or a comparable fault condition at a step 100. As it is often not desirable to operate the ATM without a journal printer, in addition to giving a paper jam signal, the processor or the paper jam signal may also operate to stop further operation of the ATM after it has completed the pending transaction.

The first fault detection signal may be generated in response to conditions other than paper jams. For example, the signal will also be given if the paper is severed or broken. This may be due to a break at a splice in the roll. The first fault detection signal will also be generated if the supply roll has not been properly installed and seated in the slots in the side walls. This will cause the roll to bind and not unwind. In each case the first fault detection signal indicates that ample paper is present but paper is not being fed in response to the printer.

Alternatively, if at step 98 it is determined that no paper is present adjacent to second sensor 78 and the encoder is not moving, then a "paper out" signal is generated at a step 102. Further, as previously discussed, in addition to generating the paper out signal, which is a second fault signal, the processor or the fault signal may operate to discontinue operation of the ATM after completing the then pending transaction.

The "paper out" signal may also be given in other comparable situations. These would include situations in which a technician has taken out a spent roll and forgotten to put in a new roll, or when a new roll has been installed so improperly that its presence cannot be sensed. In these situations, the transaction information is not being recorded due to absence of paper.

The force applied by the drag mechanism on the spindle insures that the encoder member accurately reflects the movement of paper through the journal printer. In the event of even a minor paper jam or paper feeding problem which prevents the proper operation of the printer, a fault indication signal is given. In addition, the present invention enables giving accurate signals representative of paper low and paper out conditions. This is superior to basing replacement of the paper supply roll on estimates on the amount of paper remaining. It is also not necessary to replace the roll and reset a paper counter after a paper or printer problem is corrected.

An additional advantage is that while the apparatus of the present invention is highly reliable, it does not interfere with the replacement of the paper rolls or complicate the threading of the paper through the journal printer.

It will be understood by those skilled in the art that while an opto-interrupter type sensor has been used as the detector for detecting rotation of the spindle in the preferred form of the invention, other rotation sensors may be successfully used in other embodiments. These include those detectors that sense other types of indicia or features on a member that is in connection with the spindle.

While the spring arms of the wire spring serve as the connecting members in the preferred embodiment, other types of connecting members may be used to connect the paper roll and the spindle shaft. These include other types of spring members as well as ridges or other contours which serve to provide a rigid rotational connection between the spindle and the roll.

While a reflective type detector is used for the second detector in the preferred embodiment, other types of detectors may be used. These other detectors include detectors which sense the paper between the spindle and the journal printer by way of sensing the side surface of the supply roll or other paper feature.

Thus the new fault indicating apparatus of the present invention achieves the above stated objectives, eliminates difficulties encountered in the use of prior devices and systems, solves problems and attains the desirable results described herein.

In the foregoing description, certain terms have been used for brevity, clarity and understanding. However no unnecessary limitations are to be implied therefrom because such terms are for descriptive purposes and are intended to be broadly construed. Moreover, the descriptions and illustrations herein are by way of examples and the invention is not limited to the details shown and described.

In the following claims, any feature described as a means for performing a function shall be construed as encompassing any means capable of performing the recited function, and shall not be limited to the particular means used for performing the function in the foregoing description, or mere equivalents.

Having described the features, discoveries and principles of the invention, the manner in which it is constructed and operated and the advantages and useful results attained; the new and useful structures, devices, elements, arrangements, parts, combinations, systems, equipment, operations, methods, processes and relationships are set forth in the appended claims.

We claim:

1. An apparatus for indicating a fault condition in an automated banking machine having a printer supplied with paper from a paper roll, comprising:

a printer, wherein said printer moves paper from said roll therethrough and prints thereon;

a spindle, whereby said spindle supports said paper roll;

a connecting member, wherein said connecting member is operative to hold said spindle and said paper roll in relatively fixed rotatably engaged relation;

a drag mechanism in operative connection with said spindle, wherein said drag mechanism is operative to resist rotation of said spindle and to prevent overrunning of said spindle and said roll beyond a distance said printer moves said paper;

an encoder member in connection with said spindle;

a detector adjacent said encoder member, whereby said detector detects rotation of said spindle;

an electronic circuit in connection with said printer and said detector, wherein said electronic circuit includes an apparatus that generates a first fault signal responsive to failure of said detector to detect rotation of said encoder member after said printer has operated to move said paper in response to a banking transaction by said automated banking machine.

2. The apparatus according to claim 1 and further comprising at least one wall, wherein said wall is in supporting relation with said spindle, and wherein said drag mechanism comprises a flange portion supported on said spindle adjacent said wall and a spring biasing said flange portion to engage said wall.

3. The apparatus according to claim 2 wherein said spring and said flange portion are on opposed sides of said wall.

4. The apparatus according to claim 3 wherein said spring extends between said encoder member and said wall.

5. The apparatus according to claim 4 and further comprising a retainer member, wherein said spring biases said retainer member to engage said wall on a side opposed of said side in engagement with said flange portion.

6. The apparatus according to claim 5 wherein said wall comprises a slot, whereby said spindle is movable in said slot, and wherein said retainer member includes a generally frustoconical portion adjacent said slot.

7. The apparatus according to claim 6 wherein said retainer member includes a cylindrical portion, and wherein said cylindrical portion extends axially between said frustoconical portion and said encoder member.

8. The apparatus according to claim 7 and further comprising an encoder support shaft portion extending between said encoder member and said flange portion, and wherein said spring is a compression spring, and wherein said spring is coaxial with said support shaft portion and wherein said retainer member is in surrounding relation of said spring.

9. The apparatus according to claim 2 wherein said wall comprises a slot having an open end, and wherein said spindle is supported in said slot, and wherein said spindle is removable from said slot through said open end, and wherein said spring and said flange portion are disposed on opposed sides of said wall.

10. The apparatus according to claim 9 and further comprising a second wall extending generally parallel to said first wall, and wherein said second wall includes a second slot having a second open end, and wherein an axial first end of said spindle is supported in said first slot, and a second end of said spindle generally opposed of said first end is supported in said second slot, whereby said spindle is removable from supported engagement with said walls by movement through said open ends of said first and second slots.

11. The apparatus according to claim 10 and further comprising a guide shaft portion on said spindle, said guide shaft portion extending at an axial end of said spindle opposed of said encoder support shaft portion, and wherein a radially outward step extends adjacent said guide shaft portion, and wherein said spindle is supported on said first and second side walls by said encoder support shaft portion and said guide shaft portion respectively.

12. The apparatus according to claim 2 wherein said flange portion has a side engaging said wall and a side opposed of said wall engaging face, and wherein said opposed side engages a side face of said paper roll.

13. The apparatus according to claim 1 and further comprising a second detector in connection with said electronic circuit, and wherein said second detector detects said paper between said spindle and said printer, and wherein said electronic circuit produces a second fault signal responsive to both a failure of said first detector to detect movement of said encoder member after said printer has moved the paper said distance therethrough and a failure of said second detector to detect said paper.

14. The apparatus according to claim 13 wherein said second detector is an opto-electrical detector, and wherein said second detector detects said paper in a position generally parallel and radially disposed from an axis of rotation of said spindle.

15. The apparatus according to claim 13 wherein said second detector detects a portion of a side face of said paper roll.

16. The apparatus according to claim 13 wherein said electronic circuit comprises a processor and wherein said processor is operable to execute a series of steps wherein said second fault signal is generated responsive to said printer operating to move said paper said distance, said first detector not detecting movement of said encoder member and said second detector failing to detect said paper.

17. The apparatus according to claim 1 wherein said connecting member comprises a spring arm extending from said spindle.

18. The apparatus according to claim 1 wherein said connecting member comprises a wire spring having a generally u-shaped configuration, said wire spring extending through an opening in said spindle.

19. The apparatus according to claim 1 wherein said electronic circuit includes a processor, and wherein said processor is operable to execute a series of steps wherein said first fault signal is generated responsive to detection of said printer operating to move said paper and said detector not detecting rotatable movement of said encoder member.

20. The apparatus according to claim 1 wherein said encoder member has a plurality of openings therethrough, and wherein said detector is an opto-electrical detector.

21. Apparatus for indicating a fault condition in an automated banking machine with a printer supplied with paper from a paper roll, comprising:

printing means for printing on said paper, and wherein said printing means moves paper from said roll therethrough;

rotating support means for supporting said paper roll and for rotatably moving in connection therewith;

sensing means in operative connection with said rotating support means for sensing rotation of said rotating support means;

drag means for preventing overrunning of said rotating support means beyond a distance said printing means moves said paper;

an electronic circuit in connection with said printing means and said sensing means, wherein said electronic circuit includes means to generate a first fault signal responsive to a failure of said sensing means to sense rotation of said rotating support means after said printer means has operated to move said paper in response to a banking transaction by said automated banking machine.

22. The apparatus according to claim 21 and further comprising a second sensing means for sensing said paper between said rotating support means and said printing means, wherein said second sensing means is in operative connection with said electronic circuit, and wherein said electronic circuit is operative to generate a second fault signal upon failure of said first sensing means to sense rotation of said rotating support means and failure of said second sensing means to sense said paper after said printer means has operated to move said paper said distance.

23. The apparatus according to claim 21 and further comprising a wall, and wherein said drag means comprises a radially extending face portion in connection with said rotating support means and means for biasing said radially extending face portion against said wall.

24. A method for indicating a fault condition in an automated banking machine including a printer supplied with paper from a paper roll, comprising the steps of:

connecting said paper roll to a spindle, wherein said spindle is in relatively fixed rotatable engagement with said paper roll;

moving said paper through said printer;

applying a drag force to said spindle, wherein said drag force resists rotation of the spindle and prevents overrunning of said spindle and said roll beyond a distance said paper is moved by said printer;

sensing rotation of said spindle with a first detector;

generating a first fault signal with an electronic circuit in connection with said printer and said first detector, wherein said electronic circuit is operative to generate the first fault signal when said printer has operated to move said paper said distance in response to a banking transaction by said automated banking machine and said first detector has failed to sense rotation of said spindle.

25. The method according to claim 24 wherein said system comprises a wall in supporting relation with said spindle, and said paper roll, and wherein said drag applying step comprises biasing a flange portion in connection with said spindle against said wall.

26. The method according to claim 25 wherein said wall comprises a slot and wherein said spindle is movable along said slot and rotatable therein, and wherein said biasing step comprises biasing a retainer with a spring to engage a side of said wall opposed of said side in engagement with said flange portion.

27. The method according to claim 26 and wherein said slot has an open end, and wherein said retainer has a generally frustoconical portion adjacent said wall, and prior to the step of moving said paper through said printer further comprising the step of moving said spindle into said open end of said slot with said frustoconical portion of said retainer in engagement with said wall.

28. The method according to claim 25 wherein said wall comprises a slot having an open end, and wherein in the operative condition said spindle is supported in said slot, and prior to the step of moving said paper through said printer, further comprising the step of moving said spindle and said paper roll into supported connection with said wall by moving said spindle through the open end of said slot.

29. The method according to claim 24 and further comprising the steps of:

sensing said paper between said spindle and said printer with a second detector, wherein said second detector is connected to said electronic circuit; and generating a second fault signal with said electronic circuit, wherein said second fault signal is generated when said printer has operated to move said paper a distance, said first detector has failed to sense rotation of said spindle and said second detector fails to detect said paper.

30. The method according to claim 29 wherein said step of sensing said paper comprises sensing a diameter of a side face of said paper roll.

31. The method according to claim 24 wherein said sensing step comprises sensing rotation of an encoder on said spindle.

32. The method according to claim 24 wherein said step of connecting said paper roll to said spindle comprises biasingly engaging a spring arm extending from said spindle with said paper roll.

33. An apparatus for indicating a fault condition in a system having a printer supplied with paper from a paper roll, comprising:

a printer, wherein said printer moves paper from said roll therethrough and prints thereon;

a spindle, wherein said spindle is in operative connection with a generally radially extending flange surface, whereby said spindle supports said paper roll;

a connecting member, wherein said connecting member holds said spindle and said paper roll in rotatably engaged relation;

a wall, wherein the wall is in operative connection with the spindle, and further comprising a biasing mechanism in operative connection with the flange surface and the wall, wherein said biasing mechanism biases the flange surface and the wall into operative engagement to produce a drag force, wherein said drag force generally prevents overrunning of the roll beyond a distance the printer moves the paper;

an encoder member in operative connection with said spindle;

a detector adjacent said encoder member, whereby said detector detects rotation of said spindle;

an electronic circuit in connection with said printer and said detector, wherein a first fault signal is generated responsive to failure of said detector to detect rotation of said encoder member after said printer has operated to move said paper a distance therethrough.

34. The apparatus according to claim 33 wherein said connecting member comprises a wire spring.

35. An apparatus for indicating a fault condition in a system having a printer supplied with paper from a paper roll, comprising:

a printer, wherein said printer moves paper from said roll therethrough and prints thereon;

a spindle, whereby said spindle supports said paper roll, and a flange portion supported on said spindle;

a connecting member, wherein said connecting member holds said spindle and said paper roll in rotatably engaged relation;

at least one wall in supporting relation with said spindle and wherein said flange portion is adjacent said wall;

a drag mechanism including a spring biasing said flange portion to engage said wall, whereby said drag mechanism prevents overrunning of said roll as said printer moves said paper;

an encoder member in connection with said spindle;

a detector adjacent said encoder member, whereby said detector detects rotation of said spindle;

an electronic circuit in connection with said printer and said detector, wherein a first fault signal is generated responsive to failure of said detector to detect rotation of said encoder member after said printer has operated to move said paper a distance therethrough.

36. A method for indicating a fault condition in a system including a printer supplied with paper from a paper roll, comprising the steps of;

connecting said paper roll to a spindle, wherein said spindle is rotatably engaged with said paper roll, and wherein said system includes a wall and wherein said spindle is in connection with a flange portion adjacent said wall;

moving said paper through said printer;

applying a drag force to said paper roll by biasing said flange portion to engage said wall;

sensing rotation of said spindle with a first detector;

generating a first fault signal with an electronic circuit in connection with said printer and said first detector, wherein said first fault signal is generated when said printer has operated to move said paper a distance and said first detector has failed to sense rotation of said spindle.

37. An apparatus for indicating a fault condition in a system having a printer, wherein said printer moves paper from a paper roll therethrough and prints thereon;

a wall in supporting connection with the paper roll;

a detector, wherein the detector senses movement of an encoder, and an electronic circuit in connection with the printer and the detector, wherein a first fault signal is generated responsive to the failure of the detector to sense movement of the encoder after the printer has operated to move the paper a distance therethrough;

an improvement comprising:

a spindle, whereby said spindle supports said paper roll and wherein the spindle is engageable in supporting connection with the wall;

a connecting member in operative connection with the spindle, wherein the connecting member is engageable with the paper roll to hold said spindle and said paper roll in rotatably engaged relation;

a radially extending flange surface in connection with the spindle, and a spring in connection with the spindle, wherein the spring is operative to bias the flange surface into engagement with the wall when the spindle is in supporting connection with the wall to produce a drag force, wherein the drag force generally prevents overrunning of the roll beyond a distance the printer moves the paper; and an encoder member in connection with said spindle, wherein in the operative condition of the spindle the detector is enabled to sense movement of the encoder.

38. A method for indicating a fault condition in a system including a printer supplied with paper from a paper roll, comprising the steps of;

connecting said paper roll to a spindle, wherein said spindle is in rotationally fixed, releasable engagement with the spindle;

moving the spindle and the paper roll engaged therewith into rotationally movable supporting connection with a wall, wherein when said spindle is in supporting connection with the wall a generally radially extending flange surface in operative connection with the spindle is biased into engagement with the wall by a spring;

moving said paper from said roll through said printer wherein the engagement of the flange surface and the wall applies a drag force operative to oppose rotational movement of the spindle;

sensing rotation of said spindle with a first detector;

generating a first fault signal with an electronic circuit in connection with said printer and said first detector, wherein said first fault signal is generated when said printer has operated to move said paper a distance and said first detector has failed to sense rotation of said spindle.

39. A method for indicating a fault condition in an automated banking machine including a journal printer supplied with paper from a paper roll, comprising the steps of:

connecting said paper roll to a spindle, wherein said spindle is in relatively fixed rotatable engagement with said paper roll;

installing the spindle in movably mounted connection with the machine;

extending the paper through the printer;

conducting banking transactions with said machine;

moving said paper through said printer responsive to each transaction conducted with said machine;

sensing rotation of said spindle with a detector;

generating a first fault signal with an electronic circuit in operative connection with said printer and said detector, wherein said first fault signal is generated responsive to the conduct of a banking transaction with said machine and said detector failing to sense rotation of said spindle.

40. A method for indicating a fault condition in an automated banking machine, the machine including a journal printer supplied with paper from a paper roll, comprising the steps of:

extending the paper from the roll through the journal printer;

conducting banking transactions with said machine;

moving the paper through the journal printer responsive to each transaction conducted with said machine;

sensing with a sensing device that the journal printer has moved said paper; generating a first fault signal with an electronic circuit responsive to the conduct of a banking transaction with said machine and said sensing device failing to sense movement of the paper through the journal printer.

* * * * *